US007448500B2

(12) United States Patent
Metcalfe, III et al.

(10) Patent No.: US 7,448,500 B2
(45) Date of Patent: Nov. 11, 2008

(54) METHOD AND DEVICE FOR SEPARATING PARTICULATE MATERIAL

(75) Inventors: Guy Parker Metcalfe, III, Mentone (AU); Kurt Liffman, Glen Waverley (AU)

(73) Assignee: Commonwealth Scientific and Industrial Research Organisation, Campbell (AU)

( * ) Notice: Subject to any disclaimer, the term of this patent is extended or adjusted under 35 U.S.C. 154(b) by 339 days.

(21) Appl. No.: 10/484,968

(22) PCT Filed: Aug. 1, 2002

(86) PCT No.: PCT/AU02/01025

§ 371 (c)(1),
(2), (4) Date: Jul. 23, 2004

(87) PCT Pub. No.: WO03/011483

PCT Pub. Date: Feb. 13, 2003

(65) Prior Publication Data

US 2004/0251181 A1 Dec. 16, 2004

(30) Foreign Application Priority Data

Aug. 1, 2001 (AU) ..... PR6755

(51) Int. Cl.
*B03B 5/00* (2006.01)
*B07C 9/00* (2006.01)

(52) U.S. Cl. ..... 209/689; 209/480; 209/482; 209/505; 209/451

(58) Field of Classification Search ..... 209/479–482, 209/484, 490, 494, 497, 505, 450, 451, 634, 209/689, 690
See application file for complete search history.

(56) References Cited

U.S. PATENT DOCUMENTS

| | | | | | |
|---|---|---|---|---|---|
| 327,707 | A | * | 10/1885 | Moffit | 209/44 |
| 2,872,300 | A | * | 2/1959 | Pollock | 23/314 |
| 3,804,249 | A | * | 4/1974 | Gibbons et al. | 209/473 |
| 4,070,202 | A | * | 1/1978 | Nollet | 106/407 |

FOREIGN PATENT DOCUMENTS

| | | | |
|---|---|---|---|
| SU | 1458031 | | 2/1989 |
| SU | 1458031 | A * | 2/1989 |

(Continued)

OTHER PUBLICATIONS

Supplementary European Search Report for EP Appln. No. 02750658.

(Continued)

*Primary Examiner*—Patrick Mackey
*Assistant Examiner*—Mark Hageman
(74) *Attorney, Agent, or Firm*—Kenyon & Kenyon LLP

(57) ABSTRACT

A method of separating particulate material of differing size or density including the steps of: tumbling the particulate material to produce continuous or discrete avalanches (19) in the surface of the particulate material to move particles of smaller size (14) or higher density (22) towards the centre of the particulate material and particles of larger size (16) or lower density (24) radially outward from the centre of the particulate material; and extracting particles at selected radial locations (8, 10). A device for separating particulate material of differing size or density is also provided.

23 Claims, 4 Drawing Sheets

FOREIGN PATENT DOCUMENTS

| | | | | |
|---|---|---|---|---|
| SU | 1458031 | A1 | | 2/1989 |
| SU | 1632520 | A | * | 3/1991 |
| SU | 1715446 | | | 2/1992 |
| SU | 1715446 | A | * | 2/1992 |
| SU | 1715446 | A1 | | 2/1992 |

OTHER PUBLICATIONS

Chinese Office Action for Chinese Appln. No. 02816731.7.

H. Henein et al., "Experimental Study of Transverse Bed Motion in Rotary Kilns," Metallurgical Transactions B, v. 14B, pp. 191-192, Jun. 1983.

* cited by examiner

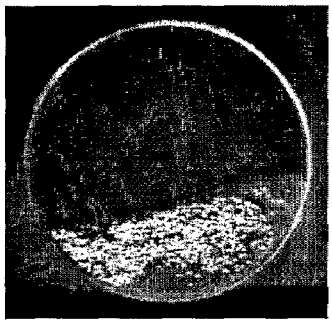
6(a)
Fig. 6
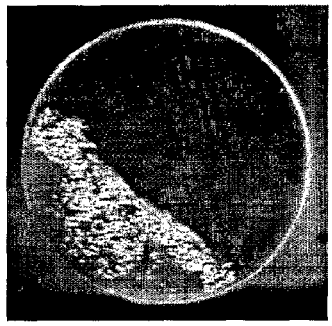
6(b)
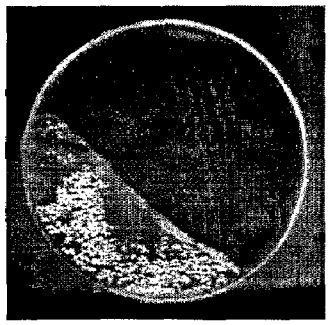
6(c)
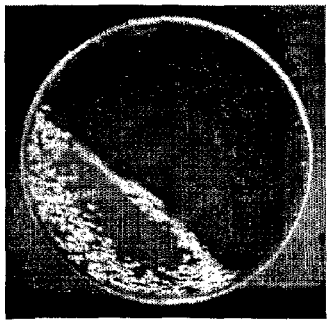
6(d)
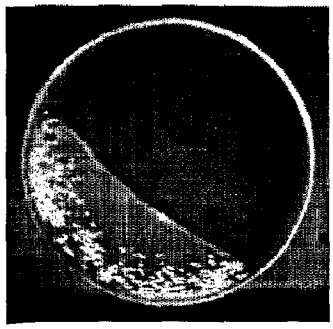
6(e)

METHOD AND DEVICE FOR SEPARATING PARTICULATE MATERIAL

This is a 371 of PCT/AU02/01025 filed 1 Aug. 2002, which claims priority to PR 6755 filed 1 Aug. 2001, the contents of which are incorporated herein by reference.

FIELD OF THE INVENTION

The invention relates to a method and device for separating particulate material. In particular, the invention relates to devices for classifying, sorting or filtering particulate material.

BACKGROUND OF THE INVENTION

The term "particulate material" refers to granular or powdered material such as sand, minerals, rock, gravel, grain, seed and other similar material.

Sorting or classifying devices are used in a number of industries, such as the construction, recycling and mining industries. These devices are used to separate particulate materials from other undesired substances based on the size of the particulate material. This type of classification is commonly done using screening techniques.

A known device for sorting particulate material takes the form of a rotary cylindrical screen having holes of a predetermined size with a series of rotating single row brushes located within the rotary screen. A screw auger feeds particulate material into the screen and the rotary brushes sweep the particulate material against the screens, causing particles below or at the predetermined size to fall through the holes in the screen and particles larger than the predetermined size to pass along the screen for rejection.

Sorting devices, including the known device, suffer from one or more of several disadvantages. In some devices, particles approaching the predetermined size can wedge into the holes of the screen. This disrupts the sorting process as well as requiring frequent maintenance of those devices. Many existing sorting devices require screen replacement in order to vary the size of sorting particulate material. Particles hitting the screen in some devices, often at high speed, can cause damage and wear to the screen.

DISCLOSURE OF THE INVENTION

According to one aspect of the invention there is provided a method of separating particulate material of differing size or density, the method including the steps of:

tumbling the particulate material to produce continuous or discrete avalanches in the surface of the particulate material to move particles of smaller size or higher density towards the centre of the particulate material and particles of larger size or lower density radially outward from the centre of the particulate material; and extracting particles at selected radial locations.

According to another aspect of the invention, there is provided a device for separating particulate material of differing size or density, including:

a rotatable vessel for receiving particulate material;

means for feeding particulate material into the rotatable vessel;

means for rotating the vessel to tumble the particulate material, producing continuous or discrete avalanches in the surface of the particulate material to move particles of smaller size or higher density towards the centre of the particulate material and particles of larger size or lower density radially outward from the centre; and means for extracting particulate material at selected radial locations.

As used in this specification term "avalanche" refers to continuous flow regimes or intermittent (discrete) flow regimes in which particles do not lift off the bed of material. Preferably, most of the bed of material is in solid body rotation with a relatively thin layer at the surface avalanching. The thin avalanching layer is not of uniform thickness. For example in the continuous flow regime the thickness of the avalanching layer has a parabolic profile. In accordance with the present invention the average thickness of the avalanching layer in a non-cohesive material is typically about 5 particles and can be up to about 10 particles, although the depth of the avalanching layer depends on preferred rotation speed and, to a lesser extent, on particle properties.

Tumbling the particulate material to produce avalanches in the particulate material surface promotes the separation of particles according to their size or density. In the case of particles primarily of differing size the smaller particles tend to collect towards the centre of the particulate material while larger particles tend to collect at the boundary of the particulate material. Consequently a radial distribution of particles according to their size is created enabling extraction of particles of selected size by suitably positioned extraction devices. The present invention is not limited to separating materials of differing size that have the same density. Whilst in practice many applications of the invention involve separation of particles of differing size but similar density, differing density of particles can be accommodated. However, when the ratios of particle size to density fulfil a particular and limited relationship, the tumbling action will mix the particles fulfilling that relationship instead of separating those particles. This only occurs for the number of particles obeying the relationship and not all particles in the "charge" of particles in the device. In practice, the number of particles fulfilling this relationship is typically a few percent of the entire charge of particles.

In the case of separating particulate material primarily of differing densities, tumbling the material to produce avalanches promotes the separation of the material according to its densities. More dense particles tend to collect toward the centre of the particulate materials whilst less dense particles tend to collect at the boundary of the particulate material. Again this provides for separation by collection at a suitable radial location. Separation according to density has a number of applications including for example in the recycling industry to separate a mixture of insulation and copper wire. Thus, the present invention allows particles to be extracted according to their size or density without the difficulties associated with known devices. For example, the invention does not employ a screen to sort the particulate material. This means that there is no risk of particles wedging into the screen and disrupting the sorting process. In addition, particles can be selected according to their size easily and conveniently by sampling the particulate material along its radius for the required size.

The method and device according to the invention provides for low energy consumption and does not require as much space as for known sorters using conventional screens. Furthermore, the device according to the invention has a large turn down ratio, allowing the device to be shut down and restarted with ease.

The method provides for less wear on both the particles and the device. Particles are separated under rotation and gravity and so the particles do not strike equipment at high speed. Particles tend to erode through inter-particle contact and not by contact with the device.

It is preferred that tumbling the particulate material produces a continuous or intermittent flow of particles along the surface. Particles are preferably extracted at radial locations outward from the centre of the particulate material.

The rotating means preferably tumbles the particulate material to produce a continuous or intermittent flow of particulate material along the surface. Preferably, the extracting means is located such that it extracts particulate material at radial locations outward from the centre of the particulate material.

Preferably, the extracting means is located adjacent to the rotatable vessel so that particles may be extracted along a radius of the particulate material. The extracting means may be in the form of a plate with one or more holes radially located relative to the particulate material. The extracting means may have feeders near the holes for promoting the extraction of particles. In other forms of the invention the extracting means may include one or more augers or pneumatic suction lines.

Preferably, the rotation rate of the vessel satisfies the relationship:

$$\frac{\omega^2 L}{g} \leq 1$$

where ω is the rotation rate;

L is the diameter of the vessel; and g is the acceleration of gravity.

It is preferred that particulate material is fed into the vessel to just below 50% of volumetric capacity. Preferably, the particulate material is fed into the vessel to 25% of volumetric capacity.

It is preferred that the rotatable vessel is tilted at an angle to the horizontal to promote the flow of particulate material through the vessel. Preferably, the rotatable vessel is tilted between 4° and 10° to the horizontal.

BRIEF DESCRIPTION OF THE DRAWINGS

To assist in the understanding of the invention, a preferred embodiment of the invention will now be described by way of example only, with reference to the drawings, of which:

FIGS. 6(*a*) to 6(*e*) show the separation of building sand according to size by the device of FIG. 1.

BEST MODE FOR CARRYING OUT THE INVENTION

Figure 1:
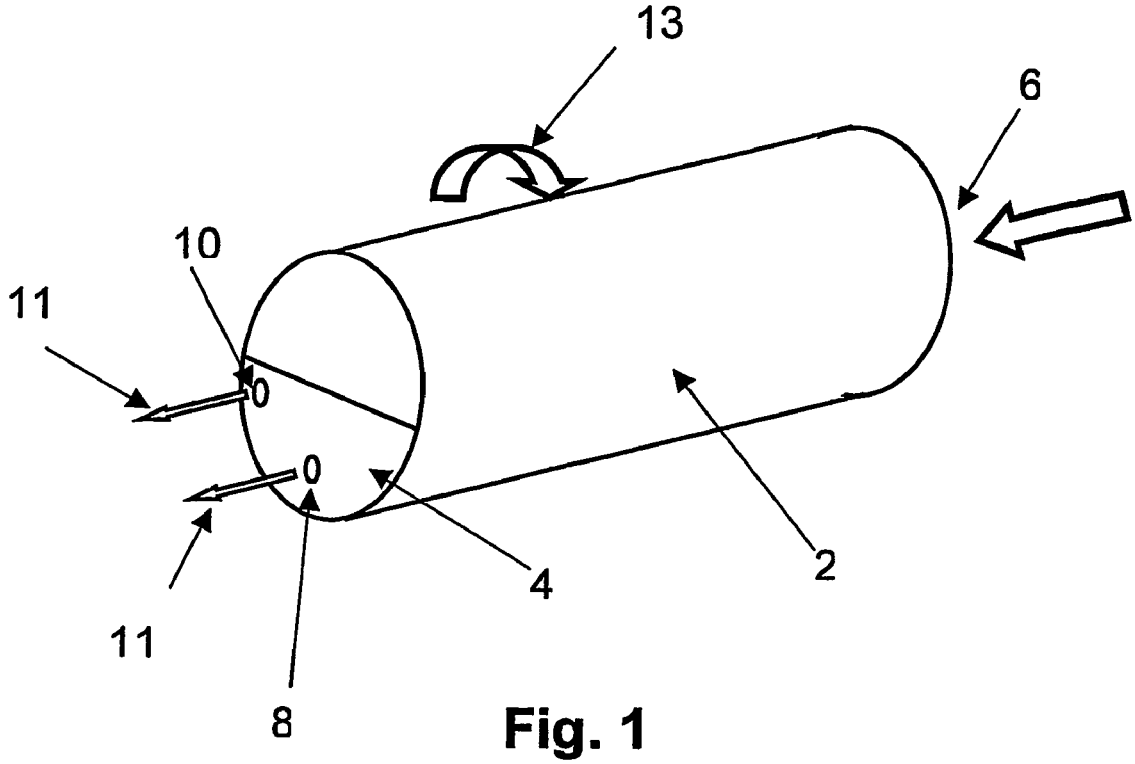
FIG. 1 is a perspective view of a device for separating particulate material according to a preferred embodiment of the invention.

Referring to FIG. 1, there is shown a device for separating particulate material in accordance with a preferred embodiment of the invention. The device comprises of a rotary longitudinal tube 2 having a fixed end plate 4.

An input 6 for receiving particulate material to be separated or sorted is located at the opposite end of the tube 2 to end plate 4. Fixed end plate 4 functions as an output for the device and has two holes 8, 10 for extracting particles from the tube 2. The size and position of holes 8, 10 determine the size or density of particles to be extracted at each respective hole. The holes or openings 8, 10 in end plate 4 are placed at different radial positions depending on the desired cut-sizes or fractions of particulate material to extract. One or several size fractions can be removed simultaneously. Small screw-feeders (not shown) near holes 8, 10 remove classified particulate material locally around the holes 8, 10 (as shown by arrows 11) and feed the classified streams away to receptacles or next processing stages, as required. Other types of extractors may be used instead of the screw-feeders. Should particles of a different size be required, the end plate 4 can be easily replaced with holes of the required size. The number of holes in the end plate 4 may be varied according to requirements.

Figure 2:
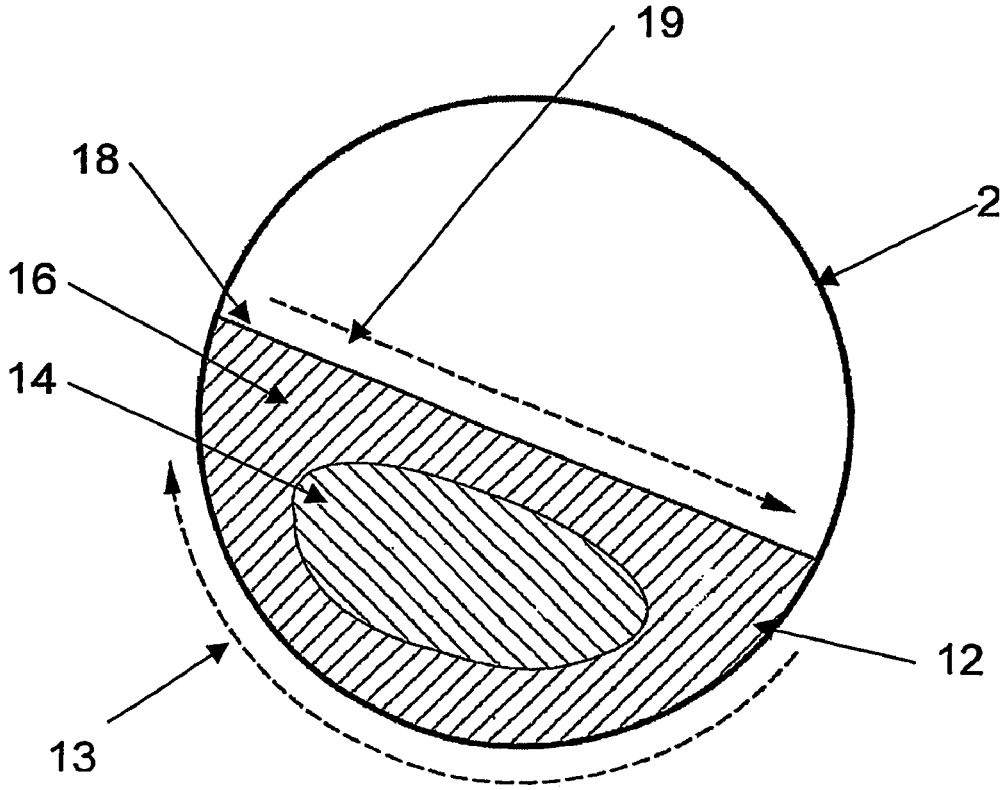
FIG. 2 is a sectional view of the device of FIG. 1 illustrating the method of separating particulate material.

FIG. 2 illustrates the device and method in operation. A "charge" of particle material 12 is placed into tube 2. As the tube 2 rotates (in the direction of arrow 13), the particulate or granular material will first support a slope 18 until the slope 18 exceeds a critical angle. Further rotation past this point initiates an avalanche of material, as indicated by arrow 19 in broken lines. This avalanche 19 takes the material in the upper half of the slope 18 and moves it to the lower half of the slope 18. During the avalanche 19, particulate material is spread out on the slope 18, causing smaller particles 14 to move or percolate downwards. As charge 12 is rotating as a solid body, the action of the avalanche 19 on the particles 14, 16 during their traverses of the avalanching region causes the particles of smaller size 14 to move towards the centre of the charge 12, instead of the bottom of charge 12. Similarly, particles of larger size 16 move towards the boundary of charge 12. Repeated avalanching rapidly segregates the entire charge 12 by size as shown in FIG. 2. If the particle size is distributed over a continuum of values, then the sizes are segregated with the smallest particles 14 in the centre of the charge 12 and the largest particles 16 on the boundary of the tube 2 with a continuous radial gradation of sized particles.

Figure 3:
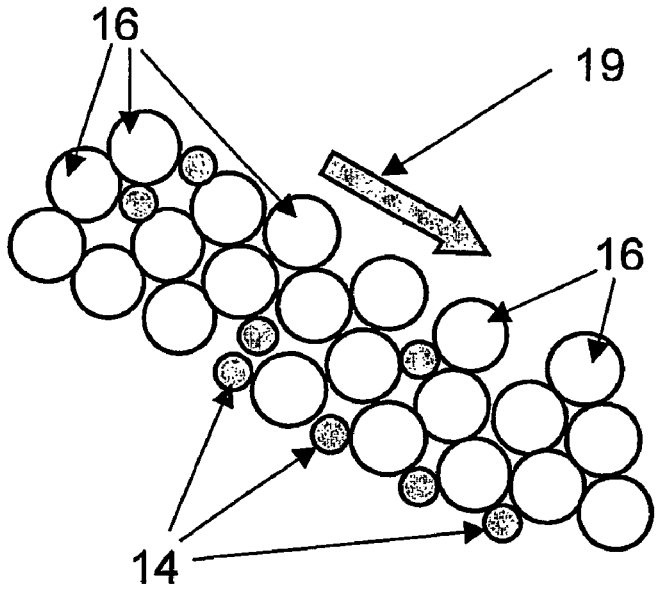
FIG. 3 is an illustration of the principles of the method of separating particulate material as applied by the device of FIG. 1.

The physical mechanism for the size segregation is described in more detail with reference to FIG. 3. When stationary, granules or particles interlock in groups. During the avalanche 19, the moving groups of particles dilate, i.e. they move farther apart from each other. This dilation increases the average spacing between particles that in turn allows smaller particles 14 to percolate downwards under the influence of gravity. When not spherical, as drawn, large particles 16 can also be rotated up to the surface by the differential velocities in the avalanching layer. Consequently, repeated avalanches promote the separation of particles 14 and larger particles 16.

It can be seen that the rate of rotation of the tube 2 determines the rate of separation. If the rotation rate is slow, avalanches 19 are discrete. If the rotation rate is faster then avalanches 19 blend into one another forming a continuous flow. If the rotation rate is faster still, a cascading motion is produced in which particles are lifted off the surface of the charge. Such cascading motion or flow is not favourable to particle separation. Furthermore, if the rotation rate is too fast, centrifugal forces cause the particles to stick to the sides of the tube 2, preventing particle separation.

The rotation rate, and so the different types of separation, can be measured by the Froude number. The Froude number is defined by the following equation:

$$Fr = \frac{\omega^2 L}{g} \tag{1}$$

where Fr is the Froude number;

ω is the angular velocity or rotation rate;

L is the tube diameter or radius; and g is the acceleration of gravity.

A Froude number in the range of $Fr<10^{-3}$ to $10^{-2}$ means that the rotation rate ω produces discrete avalanches. Generally, a transition from avalanching to continuous flow occurs over the range $10^{-3}<Fr<10^{-2}$. A continuous flow regime is produced for Froude numbers up to $Fr=10^{-1}$. Froude numbers in the range of $10^{-1}<Fr<1$ means that the rotation rate ω generates a cascading motion of particulate material. Rotation rates of Fr>1 produce centrifugal motion and particulate material ceases to separate.

The avalanching 19 usually occurs at a thin surface layer of the charge 12 of particulate material. While this layer is not uniform, it has been found that the number of particles in the surface layer averages between 5 and 10 particles. In addition, the shape of the surface layer varies according to the rotation rate. For a discrete avalanche regime, the surface layer is triangular in cross section, while for a continuous flow regime the surface layer become more parabolic in cross section with more material towards the middle.

It has been estimated that there are approximately 30 avalanches during one revolution of the tube 2 at 5 rpm. It has also been found that 5 revolutions of tube 2 at 3 rpm is sufficient to achieve full separation of particulate material at 25% capacity.

The device can be tilted at small angles to promote flow through the device. Typical angles of 4°-5° are generally sufficient to allow a suitable flow of material through the device for separation with an upper limit of 10°.

The optimum filling for a tube with a circular cross-section is 25% capacity or one quarter full as this promotes the most rapid segregation. Fill capacities of up to less than 50% may be used for the device but with lower rates of separation.

In a continuous operation, feeder and extractor rates would be tied together to maintain a fill point around the optimum of 25% capacity. However, it may also be desirable to allow wide variations from the optimum as this would mean the classifier equipment could also act as a "buffer" against unexpected material flows from upstream or downstream processing upsets.

When very exacting separation within the fine component is the end goal, the device may be used to remove the coarse component of particulate material rapidly and cheaply. Operated near its optimum fill with very rapid and complete segregation means that the device may be particularly apt for rapid, high-volume, first-pass, coarse segregation.

Figure 4:
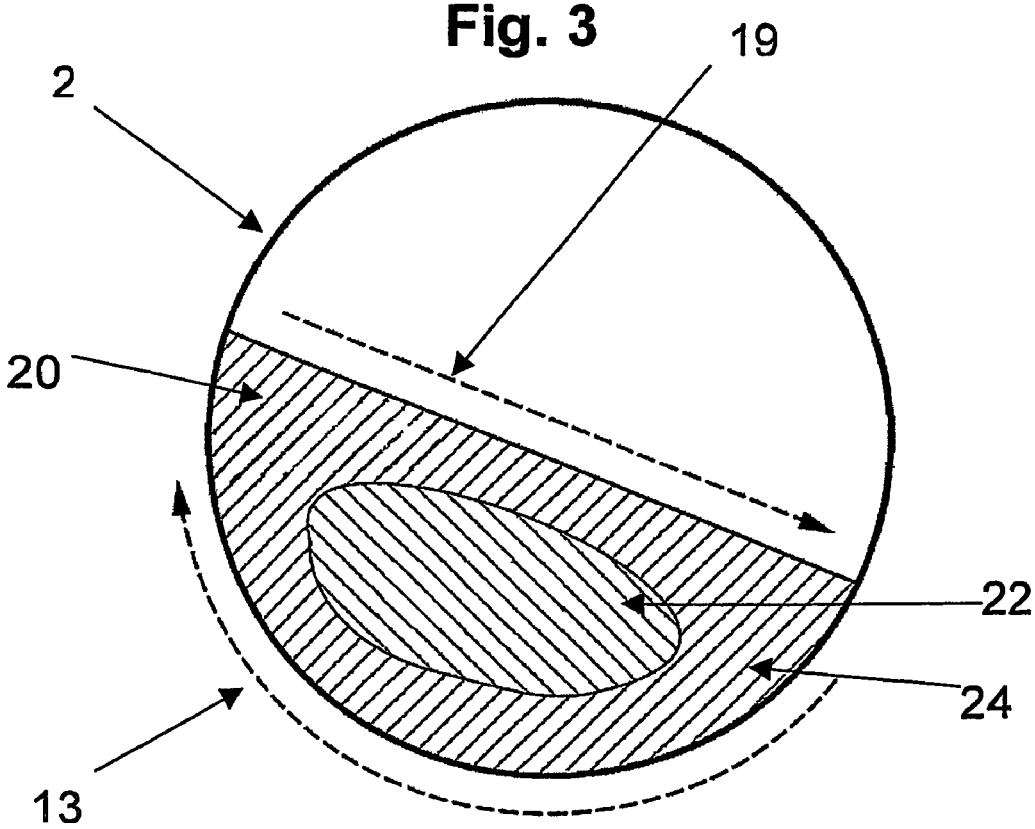
FIG. 4 illustrates the method when applied to separating particles according to density.

It has also been found that classification by density of particle gives a similar result, though from a somewhat different mechanism. FIG. 4 shows the results for a charge of particles 20 with a bimodal density distribution. The denser particles 22 will collect in the center of the charge 20 and the less dense particles 24 will collect at the boundary of the charge 20.

Figure 5:
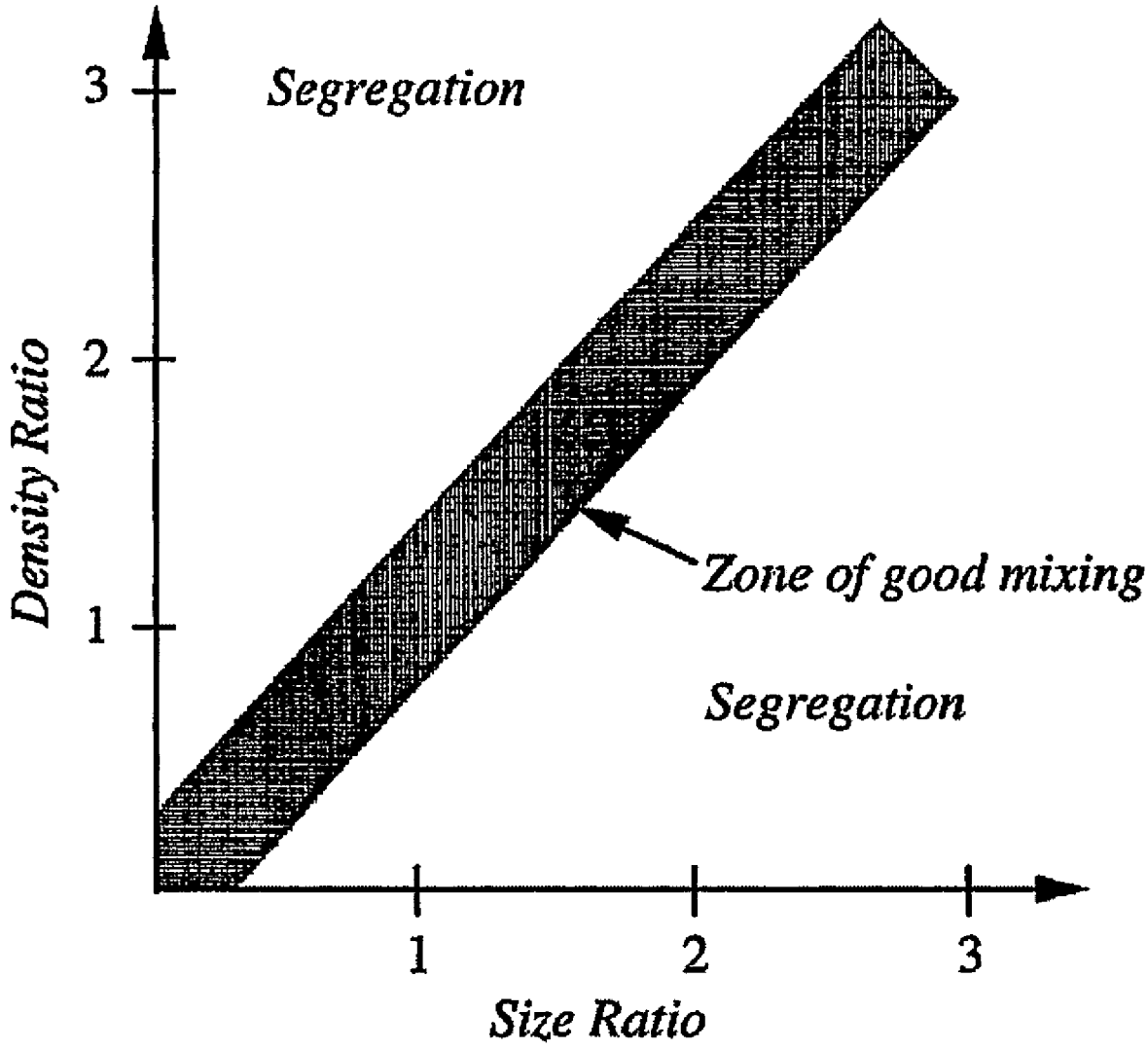
FIG. 5 shows schematically the particular relationship between particle size and density for which mixing occurs.

In some applications radial gradients of density and size difference introduce design criteria for the separating device. As exemplified by FIG. 5, particles that are both large and dense in a particular ratio tend to mix instead of to separate. However, this mixing zone tends to be small, and in practice many industrial situations classify particles that do not vary greatly in density.

So far the preferred embodiments discussed have used particles with bimodal distribution of size or density. However, the device is not restricted in any way by property distributions. FIG. 6 shows a cross section of a device according to the invention separating building sand according to size. Prior to starting, sand was sifted into four groups of equal masses. The second largest sized group was painted (shown in white). The groups were remixed and poured into the device. FIG. 6(*a*) is the initial condition and 6(*e*) is after 20 revolutions of the device at 3 rpm. As the sand particle size is distributed over a continuum of values, they are classified with the smallest particles in the centre of the charge and the largest on the boundary of the container with a continuous radial gradation of sized particles.

An experiment was performed using the same device with the particulate material being salt. In this test the larger half of the salt size distribution had been dyed green. Classification was complete in the device after 3 revolutions at 2 rpm.

The foregoing describes only one embodiment of the invention and modifications can be made without departing from the scope of the invention.

The invention claimed is:

1. A method of separating particulate material of differing size or density, the method comprising:

feeding the particulate material into a rotatable vessel having a volumetric capacity, wherein the particulate material is fed into the vessel so that the particulate material occupies less than 50% of the volumetric capacity;

rotating the vessel at a rotation rate to tumble the particulate material, the rotation rate satisfying the relationship $$10^{-3} \le \frac{\omega^2 L}{g} \le 10^{-1}$$

where ω is the rotation rate, L is a diameter of the vessel and g is the acceleration of gravity; and extracting particles of the particulate material at selected radial locations of the vessel;

wherein the particulate material is tumbled to produce a continuous or discrete surface avalanching particulate layer to move particles of smaller size or higher density towards the center of the particulate material and particles of larger size or lower density radially outward from the center of the particulate material.

2. The method of claim 1, wherein the particulate material is fed into the vessel and extracted from the vessel in continuous operation to maintain the volume of particulate material at a particular volumetric capacity of the vessel.

3. The method of claim 2, wherein the particular volumetric capacity is around 25%.

4. The method of claim 1, wherein the particulate material is fed into the vessel so that the particulate material occupies around 25% of the volumetric capacity.

5. The method of claim 1, further comprising tilting the vessel at an angle to the horizontal to promote flow of the particulate material through the vessel.

6. The method of claim 5, wherein the angle is between 4 and 10 degrees.

7. The method of claim 5, wherein the angle is between 4 and 5 degrees.

8. The method of claim 1, wherein the extracting is performed at the selected locations through respective holes in a fixed plate disposed adjacent the particulate material.

9. The method of claim 8, wherein the extracting is performed at the selected locations using at least one of augers and pneumatic suction lines.

10. The method of claim 8, wherein the extracting is performed using feeders disposed near the respective holes.

11. A method of separating particulate material of differing size or density, the method comprising:

feeding the particulate material into a rotatable vessel;

rotating the vessel at a rotation rate to tumble the particulate material, the rotation rate satisfying the relationship $$10^{-3} \leq \frac{\omega^2 L}{g} \leq 10^{-1}$$

where ω is the rotation rate, L is a diameter of the vessel and g is the acceleration of gravity; and extracting particles of the particulate material at selected radial locations through respective holes in a fixed plate disposed adjacent the particulate material, the extracting being performed using at least one of augers and pneumatic suction lines;

wherein the particulate material is tumbled to produce a continuous or discrete surface avalanching particulate layer to move particles of smaller size or higher density towards the center of the particulate material and particles of larger size or lower density radially outward from the center of the particulate material.

12. The method of claim 11, wherein the particulate material is fed into the vessel and extracted from the vessel in continuous operation to maintain the volume of particulate material at a particular volumetric capacity of the vessel.

13. The method of claim 11, wherein the particular volumetric capacity is around 25%.

14. The method of claim 11, wherein the particulate material is fed into the vessel so that the particulate material occupies around 25 % of the volumetric capacity.

15. The method of claim 11, further comprising tilting the vessel at an angle to the horizontal to promote flow of the particulate material through the vessel.

16. The method of claim 15, wherein the angle is between 4 and 10 degrees.

17. The method of claim 15, wherein the angle is between 4 and 5 degrees.

18. A device for separating particulate material of differing size or density, comprising:

a rotatable vessel for receiving the particulate material;

a feeder for feeding the particulate material into the rotatable vessel;

means for rotating the vessel at a rotation rate sufficient to cause continuous or discrete avalanching of the particulate material during rotation of the vessel; and an extractor for extracting particles of the particulate material at selected radial locations of the vessel, the extractor comprising a fixed plate disposed adjacent the particulate material and comprising at least one of augers and pneumatic suction lines, wherein the fixed plate has respective holes for allowing extraction of the particles at the selected radial locations using the augers or pneumatic suction lines; and wherein the particulate material is tumbled to produce a continuous or discrete surface avalanching particulate layer to move particles of smaller size or higher density towards the center of the particulate material and particles of larger size or lower density radially outward from the center of the particulate material.

19. The device of claim 18, wherein the vessel is tilted at an angle to the horizontal to promote flow of the particulate material through the vessel.

20. The device of claim 19, wherein the angle is between 4 and 10 degrees.

21. The device of claim 19, wherein the angle is between 4 and 5 degrees.

22. The device of claim 19, wherein the feeder and extractor are respectively configured to feed into and extract from the vessel particulate material in continuous operation to maintain the volume of particulate material at a particular volumetric capacity of the vessel.

23. The device of claim 22, wherein the means for rotating controls the rotation rate so that the rotation rate satisfies the relationship $$10^{-3} \leq \frac{\omega^2 L}{g} \leq 10^{-1}$$

where w is the rotation rate, L is a diameter of the vessel and g is the acceleration of gravity.

* * * * *

UNITED STATES PATENT AND TRADEMARK OFFICE

CERTIFICATE OF CORRECTION

PATENT NO. : 7,448,500 B2
APPLICATION NO. : 10/484968
DATED : November 11, 2008
INVENTOR(S) : Guy P. Metcalfe, III It is certified that error appears in the above-identified patent and that said Letters Patent is hereby corrected as shown below:

Column 8, Line 45 “where w is the rotation” should be --where ω is the rotation--

Signed and Sealed this

Twenty-fourth Day of March, 2009

JOHN DOLL
*Acting Director of the United States Patent and Trademark Office*